United States Patent [19]

Taylor

[11] Patent Number: 4,929,193

[45] Date of Patent: May 29, 1990

[54] CONNECTOR

[75] Inventor: Robert Taylor, Coventry, R.I.

[73] Assignee: North American Specialities Corporation, N.Y.

[21] Appl. No.: 275,225

[22] Filed: Nov. 22, 1988

[51] Int. Cl.[5] ..... H01R 13/428; H01R 13/73

[52] U.S. Cl. ..... 439/567; 439/748

[58] Field of Search ..... 439/746–749, 439/751, 873, 872, 571, 572, 567, 552, 554, 555, 82

[56] References Cited

U.S. PATENT DOCUMENTS

| | | | |
|---|---|---|---|
| 2,820,209 | 1/1958 | Whitted | 439/571 |
| 2,834,951 | 5/1958 | Aquillon et al. | 439/748 |
| 3,007,132 | 10/1961 | Anderson | 439/747 |
| 3,133,780 | 5/1964 | Dean | 439/872 |
| 4,275,944 | 6/1981 | Sochor | 439/751 |
| 4,435,031 | 3/1984 | Black et al. | 439/82 |
| 4,619,495 | 10/1986 | Sochor | 439/751 |
| 4,717,219 | 1/1988 | Frantz et al. | 439/82 |
| 4,776,804 | 10/1988 | Johnson et al. | 439/572 |

OTHER PUBLICATIONS

"Breaking 50 Mil. Barrier with Component Interchangeable Edge Mount Connector System", by Jerry Sochor, Elec. Corp., Oct., 1977.

*Primary Examiner*—Gary F. Paumen

[57] ABSTRACT

A connector is disclosed which includes an insulating block having a plurality of channels therein which are substantially sized to accept terminal pins or posts of a mating component placed therein. A plurality of slots are located adjacent to the channels and respectively in communication therewith. Each channel includes a stop at the end thereof for engagement with a pin disposed therein, with the channel including a socket disposed at the bottom thereof. A plurality of contacts are placed respectively within the slots of the connector blocks with each contact having a terminal section which is sized to engage a through hole in a printed circuit board or the like, the terminal section extending from a mounting section which includes a pair of legs therein for resiliently mating with the socket of the block. The pair of legs are separated by a slot, with one leg being a short leg which is engageable with a tapered wall of the socket and the other being a contact arm which extends substantially the length of the channel slot. The contact arm includes a locking shoulder for engaging a step in the slot, the contact arm further including a projection at an end thereof which extends into the adjacent pin-receiving channel with a gap provided between the arm and the slot side wall for allowing movement of the contact arm. Provision of such legs affords firm retention of pins or posts within the connector without overstressing the contact arm. One or more locking posts may also be provided to firmly retain the connector on a mated printed circuit board or the like.

4 Claims, 3 Drawing Sheets

CONNECTOR

TECHNICAL FIELD

This invention relates to electrical connectors and more particularly to connectors which may be mounted on a printed circuit board and provide firm resilient interface of contact with a mating plug or circuit component.

BACKGROUND

It is typical in the electronics industry to employ various pins or posts to connect components to a printed circuit board. Generally, the circuit board includes a plurality of closely placed holes or pads in a particular configuration to match the configuration of the pins of a particular component. The holes are commonly through-plated with a conductive material and adapted to have the pins or posts extending from a connector or component in continuous conductive contact with the holes. Often, the pins are soldered to the board and to the component, providing an essentially permanent connection. However, in addition to direct component connection, various connectors may be used to interface between a circuit board and other circuit boards or external components or devices such as sensors, various semiconductor chips or the like. Flexible ribbon strips may be used to interface the boards or devices where direct interface is not desirable, such as interfacing a field-mounted device with a circuit board. The ribbon strips usually include end blocks or plugs having a plurality of pins or posts therein. The end blocks on a circuit ribbon may mate with connectors mounted on the devices or boards to be interfaced. These connectors are inserted into the through holes on the circuit board, with the connectors comprising an insulative polymer block having a plurality of apertures, each aperture including a conductive receptacle for connection with a respective pin for interfacing with other components.

While various connectors are available within the art, the search continues for connectors with improved locking features that provide good conductive contact between external devices and the circuit board, while limiting the potential for inadvertent disconnection. This is particularly important in attaining a low-cost solution to miniaturization (with pin spacings as small as 1/20 inch).

SUMMARY OF THE INVENTION

It is an object of the present invention to provide a connector which includes a resilient contact which cannot be overstressed through contact with pins inserted therein.

It is another object of the present invention to provide a connector which includes locking means for securely retaining the contacts therein.

It is a further object of the present invention to provide a connector which includes means for reducing torque effects during engagement of the pins with a contact within the connector.

It is an additional object to provide a relatively low cost connector design suitable for miniaturization.

According to the present invention, a connector is disclosed suitable for providing an interface between a printed circuit board or the like and a component having terminal pins, with the connector comprising:

an insulating block including a plurality of channels which extend substantially the depth of the block, each channel being sized to accept therein a terminal pin of a circuit component or plug, the block further including a slot in a wall of each channel, each slot being sized to accept a contact therein, the block further including a ledge at an end of each channel; and a plurality of contacts, each contact being disposed within a respective slot, each contact including a terminal end, a mounting section and a contact arm, the mounting section being sized to engage a respective ledge in the insulating block, the contact arm being sized for resilient retention with the ledge, the contact arm including means for engaging the terminal pin disposed within the channel, the contact further including locking means for firmly locking the contact within the insulating block.

In a preferred embodiment of the present invention, at least one compliant locking pin is included in the connector block for firmly retaining the insulating block on a printed circuit board or the like. The compliant locking pin includes an end having an expanded section slightly larger than the diameter of a board through-hole, and a wedge end for attaching securely to the block. Insertion of the expanded section within a circuit board hole thereby provides an interference fit which firmly holds the connector to the circuit board or device, preventing inadvertent release of the connector therefrom.

DETAILED DESCRIPTION OF THE PREFERRED EMBODIMENT

Figure 1:
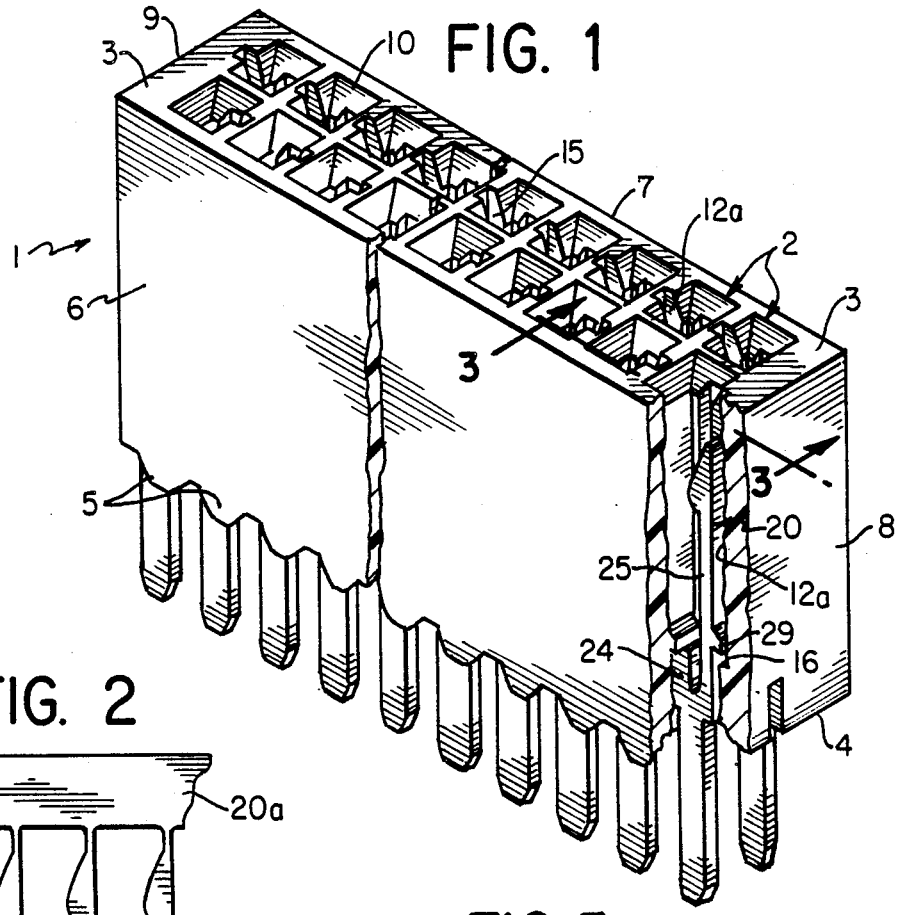
FIG. 1 is a perspective view of a connector according to the present invention including a broken-away portion to illustrate contact placement.

Referring to FIG. 1, a connector block 1 includes a plurality of apertures 2 therein, with each aperture extending as a channel substantially the depth of the block. The connector block and channels are generally sized to register with a plurality of through holes in a printed circuit board, which are usually on a spacing of about 0.050 inches. Such a spacing is illustrative, and it will be understood that even smaller configurations may be used with the present invention. In addition, while an essentially rectangular connector block is discussed, it would be apparent that other shaped blocks may also be used, as the circuit board or device configuration dictates. For ease in illustration, a connector matable with a circuit board will be described. However, it will be understood that the present invention may be used to interface various electronic devices, either directly or through connecting wires, such as circuit ribbon strips, without limiting the scope of the invention.

The connector block is composed of a conventional insulative material, with the block preferable produced through injection molding of a plastic composition, to provide a block of unitary construction. The connector block 1 includes a top surface 3, a bottom surface 4 with a plurality of spacing projections or feet 5, a pair of side walls 6 and 7, a front wall 8, and a back wall 9.

Figure 3:
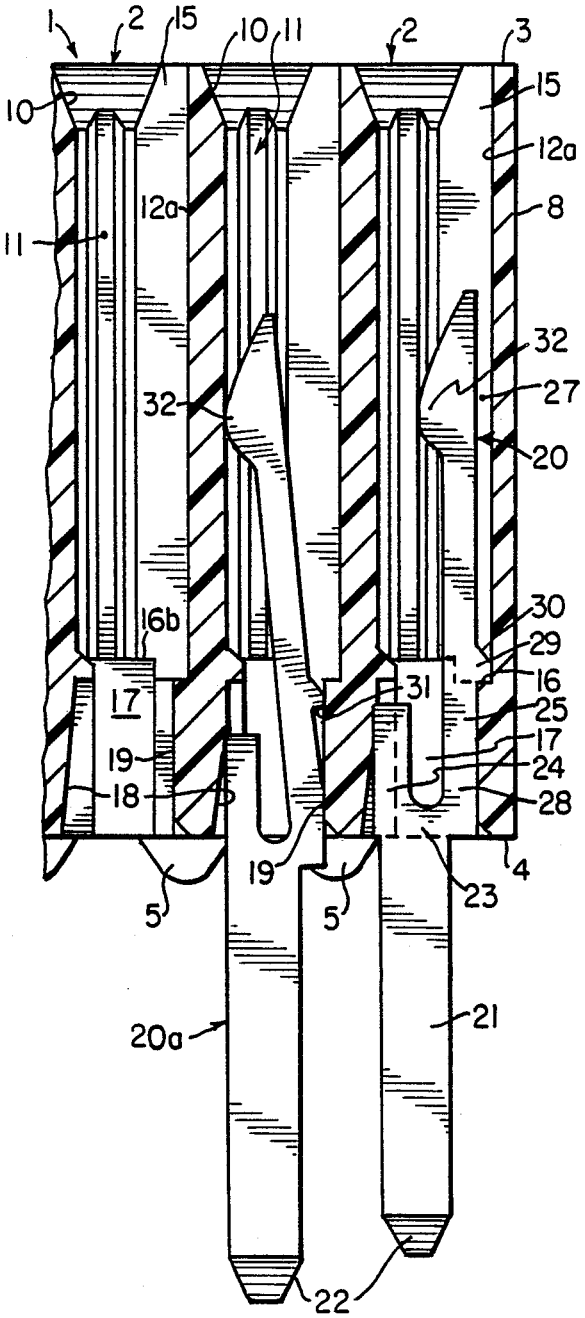
FIG. 3 is an enlarged fragmentary cross-sectional view of the connector in FIG. 1 taken along line 3—3 thereof, with one contact omitted for explanatory purposes.

Referring to FIG. 3, an enlarged view of a cross-section of the connector block of FIG. 1 is shown illustrating several apertures 2, the left one being shown prior to inclusion of a contact therein. Each aperture 2 includes a tapered entrance 10 leading to an essentially rectangular channel 11 which is sized to accept a mating terminal pin or post 33 of a component to be connected thereto. By way of example, pin 33 may have an .018 inch square cross-section, to enhance miniaturization without unduly sacrificing strength. The entry 10 is made closed, which avoids having the entering pin snub on the contact during insertion. This feature precludes the upper mold tool core pin from extending into channel 11, which might form a ledge against which a contact would latch. The channel 11 includes side walls 12 and extends nearly the depth of the block to a step 16. The channel 11 also includes recesses 13 in two of the opposing side walls to facilitate molding. While such a structure is preferred, it will be understood that any shaped channel sized to accept a terminal pin or post may be used.

The channel 11 also includes a longitudinally extending slot **12*a* in the wall of the channel perpendicular to side walls 12. The slot 12*a* is sized to accept a contact 20 described below. The slot 12*a* extends the length of the channel 11, including a step or shoulder 16 near its lower end. The channel 11 further includes a socket 17 at its lower end which communicates with the slot 12*a*. The socket 17 includes a first slightly slanted wall 18 and an essentially vertical opposite wall 19, with the socket 17 sized to accept a mounting portion 23 of a contact 20**.

Figure 2:
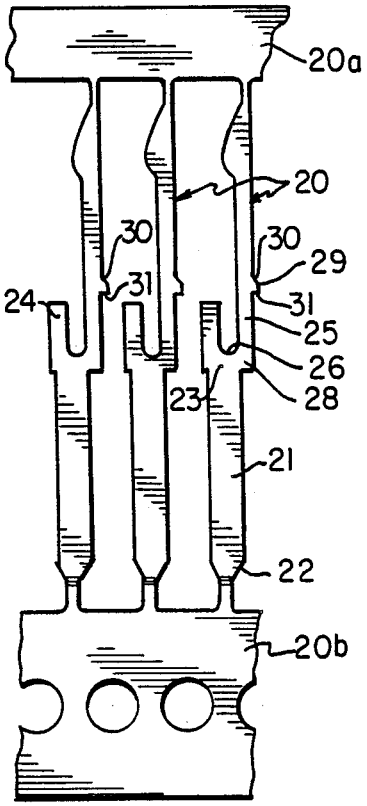
FIG. 2 is a view of a stamped blank illustrating a method for producing a plurality of contacts.
Figure 5:
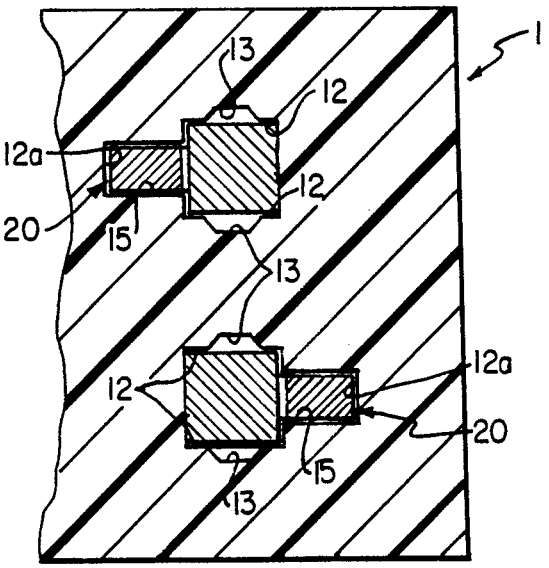
FIG. 5 is a midsection cross-sectional view taken along line 5—5 of FIG. 4 illustrating two adjacent channels.

Referring to FIG. 2, a conductive strip is shown including a plurality of contacts 20, each joined to carrier strips **20*a*, 20*b*, where the contacts 20** are formed by progressive stamping in a conventional manner. The conductive strip may be formed of beryllium copper or other resilient conductive material. This is one of the beneficial design features of the present invention, utilizing a flat blanked contact, which is more economical than a formed (e.g. cylindrical-shaped) socket characteristic of prior art. Relative to a blanked contact, a formed contact requires a more complicated approach, with more cost for the dies, is produced at a relatively slower speed and requires complicated selective plating and quality control effort.

Each contact 20 includes a board-engaging terminal pin 21 sized for engagement with, for example, a through-plated hole in a circuit board, where it may be soldered, if desired. The board-engaging section 21 may include a tapered end 22 for easing insertion into a board through-hole. The board-engaging section 21 extends from a mounting section 23 which includes a first short leg 24 disposed opposite a second longer leg 25, with the legs 24, 25, separated by a slot 26 between them. Generally, the short leg 24 is sized to have a length corresponding to that of socket 17, with the edge of short leg 24 engaging the first slanted wall 18 within the socket 17.

Referring again to FIG. 3, the center portion shows a contact **20*a* partially inserted into a channel 11, and the right portion shows a contact 20*b* fully inserted into a channel 11. The longer leg 25 of contacts 20 is sized to enter the slot 12*a* in the block 1. On inserting contact 20*a* into its socket 17, the short leg 24 engages the slanted wall 18. The longer leg 25 has a projection 29 which engages the vertical socket wall 19. Due to the taper in socket 17, on insertion of the contact, the two legs 24, 25 have their upper ends squeezed together, as shown in the center portion of FIG. 3. However, once the projection 29 clears the step 16, the longer leg assumes the position shown in the right portion of FIG. 3. A gap 27 between the end wall of slot 12*a* and contact 20 is created by projection 29 on the longer leg 25 of the contact, which engages the wall 12*a* of slot 15 to space the upper part of leg 25 from wall 12*a*. The two legs 24, 25, resiliently grip the socket walls for firmly supporting the contact 20 therein. The projection 29 of the longer leg 25 includes an upper tapered section 30 for ease of insertion of the contact 20 into the channel 11 from the bottom of FIG. 3, and also has a horizontal shoulder 31 at the bottom thereof which engages the step 16 in the bottom of the slot 12*a*. The longer leg 25 further includes a rounded projection 32 at its upper end which extends into the channel 11 for resiliently engaging a pin or post of a mating component when placed within the channel 11. The extension 32 may be of any shape, but is preferably shaped with a rounded or semicircular edge, as shown, for easing insertion of a pin in the channel 11. The edge of projection 32** may be coated with a corrosion-resistant and conduction-enhancing coating, such as gold or another noble metal.

In manufacture, the block 1 is first molded from a suitable plastic material in the desired configuration. A plurality of contacts are then produced from conductive sheet material as previously described. To assemble the connector, each contact 20 is driven into the socket 17 and slot **12*a* upwardly from the bottom. As the contact moves into the socket the legs 24, 25 are resiliently urged toward one another by the socket walls so that projection 29 moves upward until it passes step 16, whereupon the shoulder 31 passes beyond the step 16 in the slot 12*a* and an edge of the short leg 24 firmly engages the slanted socket wall 18**.

Figure 4:
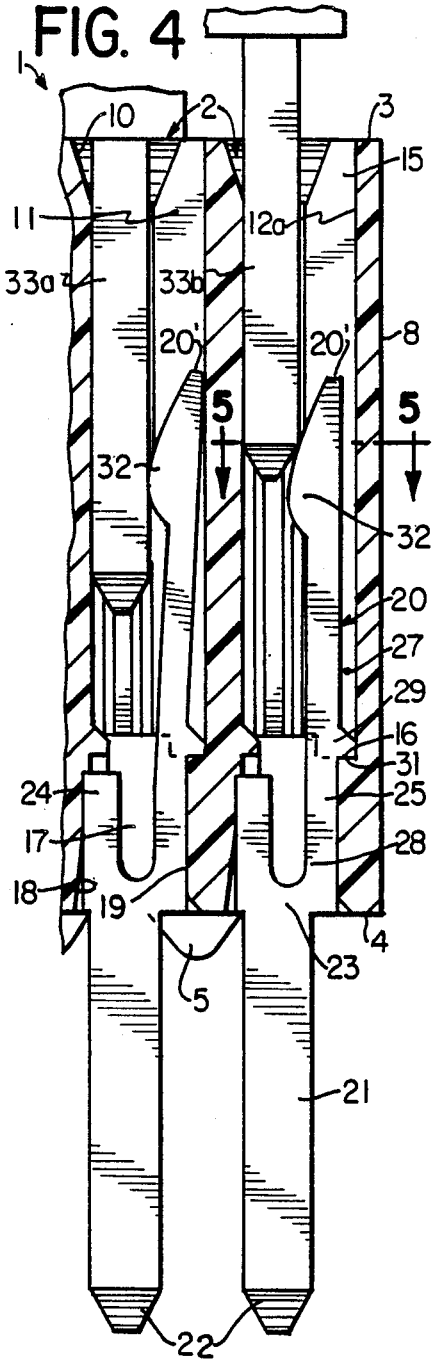
FIG. 4 is a similar enlarged fragmentary cross-sectional view of the connector of FIG. 1 including pins of a connecting element partially inserted therein.

In use, a terminal pin or post 33 of a mating component may then be inserted through the top of the aperture 2 into the channel 11 with the pin or post 33 slidably engaging the contact projection 32, pushing the long leg 25 resiliently back into the slot **12*a*. Referring to FIG. 4, a pair of pins 33, 33*b* are shown partially inserted into a pair of channels 11, at different distances. As seen at the right portion of FIG. 4, pin 33*b* has a tapered tip which first engages projection 32 on contact 20. As the pin 33 is inserted further, it causes projection 32 to move to the side, until the tip 25*a* of contact 20 engages the wall 12*a*, as shown at the left portion of FIG. 4. Each pin 33 is therefore resiliently held by leg 25 within its respective channel 11 in conductive contact with the respective contact 20**.

The present arrangement provides the advantage of firmly holding the contact 20 in place, notwithstanding the tendency of the entering pin 33 to cant or twist the contact 20. The projection 29 bears on the inner surface of slot 12*a*, and provides a fulcrum for the longer contact leg 25, so that upon insertion of the mating terminal pin 33, the longer leg 25 will bend at projection 29, in cantilever fashion. This applies a resilient force from projection 32 against pin 33 which served both to provide good electrical connection between contact 20 and pin 33, and also to force pin 33 against the opposite wall 12 of channel 11 to enhance that electrical connection. Such action is made possible by the firm retention of the lower portion of contact 20 in socket 17, and further the engagement of contact tip 25 with the wall of slot 12*a* prevents over-torquing of the contact, producing firm locking of the contact within the connector block for long-term conductive engagement. This action is provided by short leg 24, which is a stiff anti-torque spring member, which pre-loads upon insertion of the contact 20 into block 1. Leg 25 of the contact 20 is pushed firmly into slot 12*a*, and pre-loads the beam formed by the longer leg 25 so that there is no predeflections shifting. It also acts as a stop to properly place the contact 20 within the block 1.

In addition, the present invention also provides means for preventing overstress of the contact 20. If the mating terminal pin 33 should be oversize, or be inserted off center, the longer contact leg 25 can be moved by pin 33 only to the point when the upper end 25*a* of contact leg 25 touches the wall 12*a*. Thus, wall 12*a* provides a limit for contact leg 25 to prevent overstress which might affect the resiliency of leg 25 by straining the contact at the pivot point. However, contact leg 25 need not be displaced so far as to engage wall 12*a*.

The present invention thus provides the advantage of avoiding a press-fit to retain the contact in position, so that possible low retention or shattered plastic walls of the body 1 are avoided. The present invention interrupts the closed entry 2 for a dimension less than the width of a pin, to allow a ledge forming blade to extend into the cavity without defeating the closed entry feature.

The present design also permits using a small thickness of contact, which is easily blanked. Thus, for example, for a pin which is 0.018 inch square, channel 11 may be a 0.020 inch square hole still leaving adequate material (0.030 inch) between channels. Slot 12 may then be 0.012 inch wide, to accommodate a contact of 0.010 inch material. Such material can use a contact width of 0.012 inch, which will produce a normal resilient force of at least 75 grams, which is an industry standard. The protrusion 32 may be 0.005 inch deep as the desired point of contact.

Figure 6:
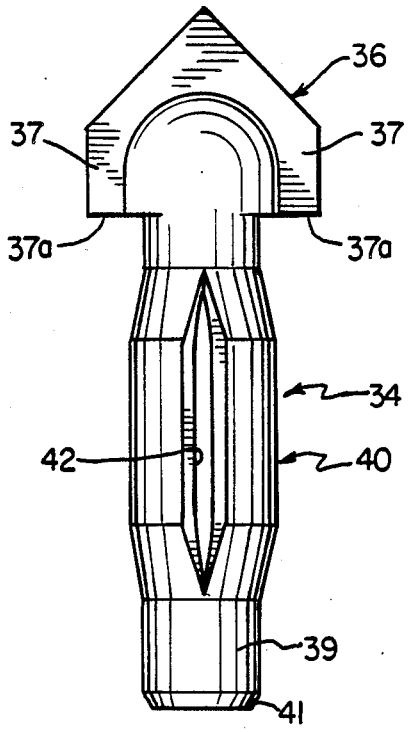
FIG. 6 is an enlarged elevation view of a compliant locking pin including an expanded section and a wedge section.
Figure 7:
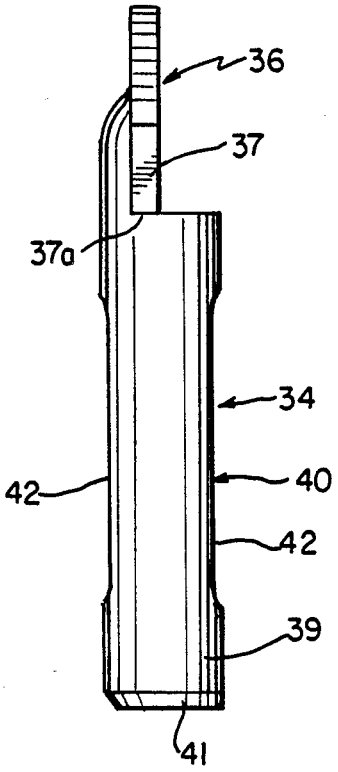
FIG. 7 is a side elevation view of the compliant locking pin of FIG. 6.
Figure 8:
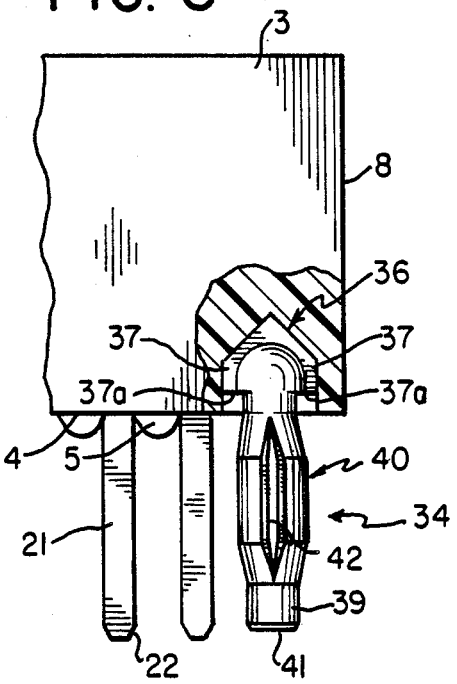
FIG. 8 is a fragmentary side view of a connector with a portion broken away to show a compliant locking pin adjacent an end thereof.

While in many situations the insertion of the terminal ends 21 into a circuit board is sufficient to retain the block firmly in place, in some instances it may be desirable to enhance the retention of the connector in its mating board, by utilizing a board-locking post. Referring to FIG. 6, a locking post is shown including an engaging head 36 which may be forced with ultrasonic vibration into a slotted aperture in the connector block. The engaging head 36 includes a pair of locking tabs 37 having shoulders 37*a* which provide edges engaging within the connector block 1 for firm retention. The locking pin 34 further includes a cylindrical end 39 which is sized to enter a through hole in a circuit board. Locking pin 34 also includes a board-engaging resilient section 40 which comprises essentially a split cylindrical section slightly larger than the board hole. The section 40 may also include a tapered end 41 to ease insertion. The split cylindrical section 40 preferably includes one or more slots 42 for allowing resilient engagement with the through holes in the circuit board. The structure of such a compliant resilient pin is preferably as described in U.S. Pat. No. 4,752,520 granted Jun. 21, 1988 in the name of Jack Seidler. That structure is particularly adapted to hold the pin in a circuit board hole or the like, very firmly and resiliently, while permitting withdrawal if desired. Such locking costs may be included at the ends or in the place of any aperture or pair of apertures provided in the connector block, wherever it is convenient. However, it is preferable to provide such locking posts, if needed, at the ends in order to assure firm holding of the connector to the printed circuit board. Referring to FIG. 8, a locking post is shown included at an end of a connector.

Utilizing contacts mounted in an insulative molded block in accordance with the present invention creates substantial improvement in providing and maintaining good electrical connection with the pins or posts of a mating component. Firm resilient contact is provided, since the pin in the elongated channel 11 is firmly lodged within the connector block by the resilient leg 25. Such firm locking assures that the mating pins or posts will be retained within the connector block. The firm locking of the contact in the socket also assures that, when desirable, the connector block can be disengaged from the circuit board without loosening of the contacts within the block, or loosening the component held in the connector. In addition, frequent pin insertion and removal will not overstress the board-engaging section, assuring long-term conductive contact.

Such a connector also has inherent advantages in terms of snap-locking the contact into the connector block, providing ease in assembly, while allowing periodic removal of the connector from a circuit board without damaging the connection to a further component. In addition, the compliant locking posts prevent the inadvertent disconnection of the connector block from the circuit board. The present invention also prevents overstressing of the contact within the channel.

While the connector has been described in relation to a rectangular block with a particular configuration of contacts disposed therein, it will be understood that the connector of the present invention may be provided with as many rows of channel/contact combinations, and as many such combinations as may be desired for the particular use to which the connector may be put.

Also, the present invention may be used as an interface not only with printed circuit boards but also with other circuit components.

It will also be understood by those skilled in the art that various evident changes or modifications could be made in the presently described structure without departing from the present invention, which is defined by the following claims:

What is claimed as the invention is:

1. A connector adapted to an interface between a printed circuit board and a circuit component or plug having a terminal pin, the connector comprising:

an insulating block including a channel which extends substantially the depth of the block between a top surface and a bottom surface of said block, said channel being sized to accept a pin of a connecting component or plug therein, the block further including a slot in a wall of said channel, the block further including a socket at an end of said channel at said bottom surface; and a contact insertable through said bottom surface into said slot and being in said slot, said contact including a terminal end, a mounting section and a contact arm, the mounting section being sized to engage said socket of the connector block, said contact arm being sized for resilient retention in said slot, said contact arm including means for engaging a terminal pin disposed within said channel, said contact arm extending from the mounting section and including a projection which extends into the channel, a gap existing between the contact arm and a wall of said slot prior to insertion of a pin within the channel, the contact arm being resiliently disposed within the slot, each contact arm further including locking means extending from the contact arm which is matable with a corresponding step disposed in the slot in the insulating block to prevent removal of said contact from said insulating block through said bottom surface, said socket including a slanted wall and a vertical wall, and said contact having a short leg engageable with said slanted wall when said contact is placed in said socket, the vertical wall being engagable by a portion of the contact arm.

2. The connector of claim 1 wherein the channel includes a tapered aperture leading therein, the channel including a stop at an inner end thereof.

3. The connector of claim 1 further comprising a compliant locking post disposable within an aperture in the connector block, the locking post including a pair of engaging ears having a pair of corresponding shoulders at a first end thereof for firmly mounting within the connector block and further including a compliant board-engaging section slightly larger than a through hole in a printed circuit board, for providing an interference fit therewith.

4. The connector of claim 1, including a plurality of said channels and a plurality of said contacts, each said contact engaging a respective said channel.

* * * * *